US012024963B2

(12) United States Patent
Nguyen

(10) Patent No.: US 12,024,963 B2
(45) Date of Patent: Jul. 2, 2024

(54) OBJECT RELEASE DEVICE, METHOD, AND SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 46 days.

(21) Appl. No.: 17/569,063

(22) Filed: Jan. 5, 2022

(65) Prior Publication Data

US 2023/0212920 A1 Jul. 6, 2023

(51) Int. Cl.
*E21B 23/00* (2006.01)
*E21B 47/01* (2012.01)
*E21B 47/12* (2012.01)

(52) U.S. Cl.
CPC ..... *E21B 23/00* (2013.01); *E21B 47/01* (2013.01); *E21B 47/12* (2013.01)

(58) Field of Classification Search
CPC ..... E21B 23/00; E21B 47/01; E21B 47/12; E21B 34/14
See application file for complete search history.

(56) References Cited

U.S. PATENT DOCUMENTS

| | | | | |
|---|---|---|---|---|
| 7,100,700 | B2 * | 9/2006 | Davis | E21B 34/14 166/318 |
| 9,739,111 | B2 | 8/2017 | Beason et al. | |
| 10,006,272 | B2 * | 6/2018 | Radford | E21B 10/322 |
| 10,597,976 | B2 * | 3/2020 | Rorvik | E21B 34/066 |
| 2003/0155114 | A1 * | 8/2003 | Pedersen | E21B 34/14 166/70 |
| 2004/0055753 | A1 | 3/2004 | Davis et al. | |
| 2015/0000901 | A1 | 1/2015 | Guidry et al. | |
| 2015/0345256 | A1 * | 12/2015 | Tulloch | E21B 25/00 175/263 |
| 2016/0222764 | A1 | 8/2016 | Rorvik | |

FOREIGN PATENT DOCUMENTS

| | | | | |
|---|---|---|---|---|
| EP | 1101012 | B1 * | 7/2011 | E21B 33/05 |
| EP | 1101012 | B1 | 7/2011 | |
| WO | WO-2021178944 | A1 * | 9/2021 | E21B 23/00 |

OTHER PUBLICATIONS

Notification of Transmittal of the International Search Report and the Written Opinion of the International Searching Authority, or the Declaration; PCT/US2022/052947; dated May 10, 2023; 10 pages.

* cited by examiner

*Primary Examiner* — Caroline N Butcher
(74) *Attorney, Agent, or Firm* — CANTOR COLBURN LLP

(57) ABSTRACT

An object release device including a housing defining a longitudinally extending through bore and an object bore intersecting the through bore and a supply bore intersecting the object bore, an object shuttle disposed in the supply bore, and a motive arrangement attached to the shuttle through a driver. A method for actuating a downhole tool including sending a signal to the motive arrangement and moving the shuttle to align an object with the object bore. A borehole system including a borehole in a subsurface formation, a string in the borehole, an object release device disposed within or as a part of the string.

13 Claims, 6 Drawing Sheets

OBJECT RELEASE DEVICE, METHOD, AND SYSTEM

BACKGROUND

In the resource recovery and fluid sequestration industries, objects such as tripping balls, darts, etc. are often used to trigger or actuate tool or operations in the downhole environment. Often the objects are dropped from surface and relatively long wait times are experienced while the object makes its way through downhole fluids to the target object seat. Waiting is particularly costly in the noted industries and is to be avoided. The art has created some systems where an object is transported with other tools or the same tool into the downhole environment and then released when needed so that the wait time for migration of the object to the intended seat is less but of those that exist, they are not always available for use in particular situations. Accordingly, the art will well receive additional configurations that reduce wait times, thereby enhancing efficiency in downhole operations.

SUMMARY

An embodiment of an object release device including a housing defining a longitudinally extending through bore and an object bore intersecting the through bore and a supply bore intersecting the object bore, an object shuttle disposed in the supply bore, and a motive arrangement attached to the shuttle through a driver.

An embodiment of a method for actuating a downhole tool including sending a signal to the motive arrangement and moving the shuttle to align an object with the object bore.

An embodiment of a borehole system including a borehole in a subsurface formation, a string in the borehole, an object release device as in any prior embodiment disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
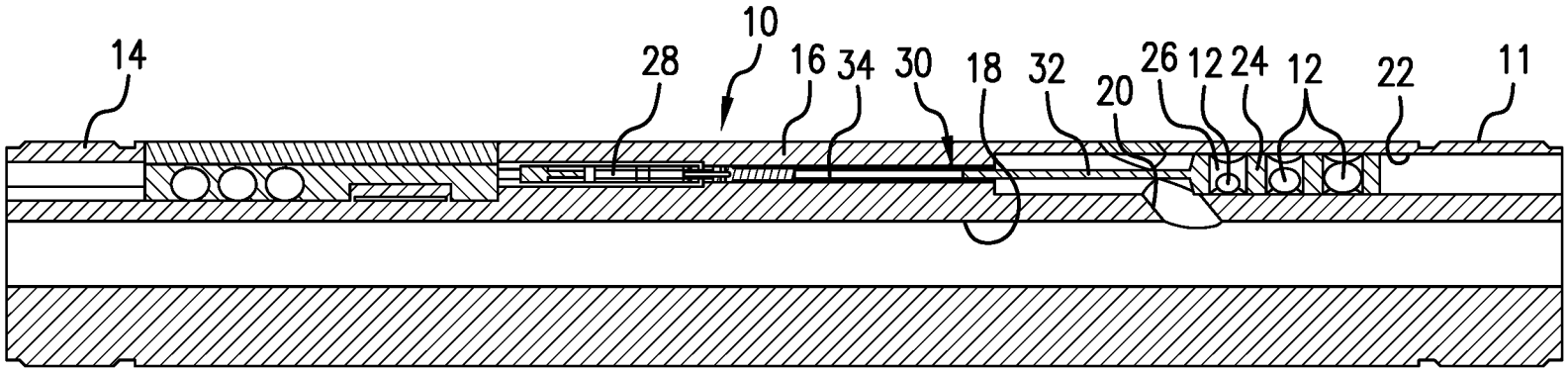
FIG. 1 is a cross sectional view of an object release device as disclosed herein in a run in position.

Referring to FIG. 1, an object release device 10 is illustrated. The device 10 is configured to be connected to a tool to be actuated usually through a string within which the device 10 is disposed. For example, the device 10 may be threadedly connected into a string (not shown this figure, see description of FIG. 7) at threads 11 and 14. The device 10 may be employed to actuate one or more tools downstream of the device 10 at will by sending a signal to the device 10 to release an object 12. Objects 12 contemplated include balls, darts, RFID tags, and any other object that may be used to communicate with or actuate another tool after release from the device 10 and combinations including at least one of the foregoing.

The device 10 comprises a housing 16 that defines a longitudinally extending through bore 18 an object bore 20 intersecting the through bore 18 and a supply bore 22 intersecting the object bore 20. Disposed within the supply bore 22 is an object shuttle 24. Object shuttle in an embodiment includes a number of recesses 26 that may be formed as annular scallops as shown or may be only part annular. Three are illustrated in FIG. 1, though it is to be understood that more or fewer are contemplated. The recesses 26 may be of the same size or different sizes to accommodate the dimensions of one or more objects 12 (one in each recess unless a particular embodiment calls for a number of objects 12 greater than one be released simultaneously, which may be the case for a tool that is actuated by a plurality of smaller objects on a plurality of smaller seats instead of one larger object on one larger seat).

Figure 2:
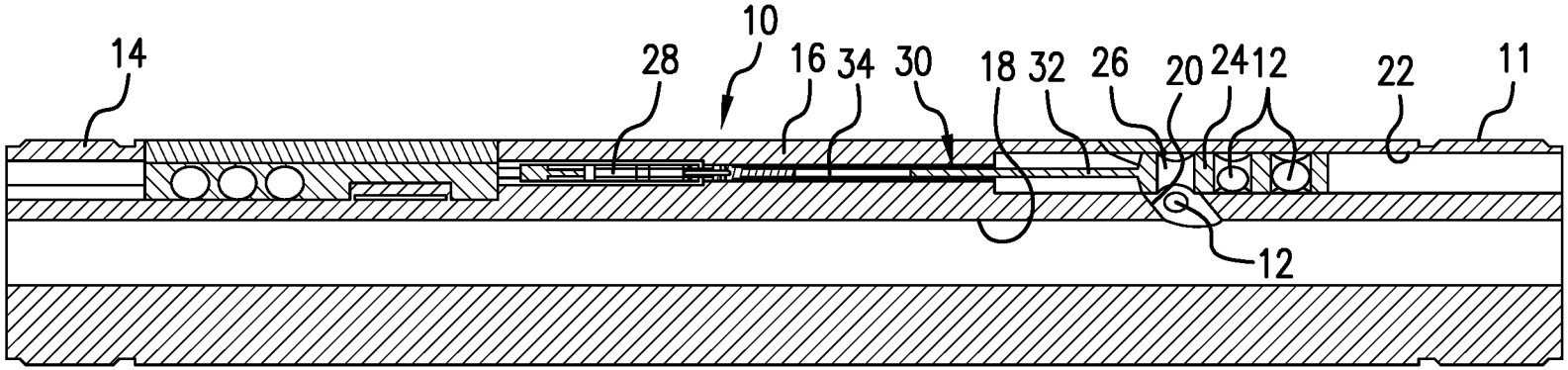
FIG. 2 is the view of FIG. 1 in a first release position.
Figure 3:
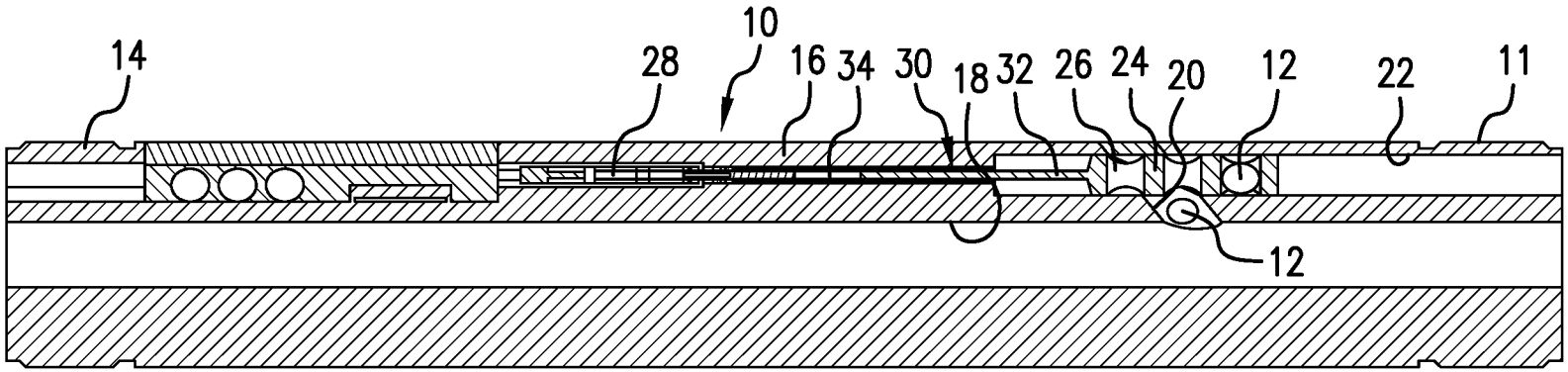
FIG. 3 is the view of FIG. 1 in a second release position.

The object shuttle 24 is moveable within the supply bore 22 differently in different embodiments. As illustrated in Figured 1-2, the shuttle 24 linearly moves in the longitudinal direction of the supply bore 22 to positions where one or another of the objects 12 are aligned with the object bore 20 and therefore allowed to drop into the object bore 20 and thence to the through bore 18. Once an object (or a number of them if that is the required condition) moves into the through bore 18, the object will move downstream to a tool that awaits the signal the object brings to actuate. This could be ball on seat or dart on seat for pressure up, or could be an RFID reader waiting for proximity of RFID signal, etc. The motion of the shuttle can be appreciated in FIGS. 1-3 by examining the position of the shuttle 24 in each sequential view.

The motion of the shuttle 24 in the FIG. 1 embodiment is accomplished by electric signal sent to a motive arrangement 28, which may be a motor. Upon activation of the motive arrangement 28, a driver 30 that may be a rotary to linear motion translator in an embodiment, such as a lead screw and follower 32 and 34, as illustrated. It is also contemplated that the motive arrangement could simply be a solenoid replacing both the motor and the rotary to linear translator. This would look essentially the same in the Figures.

Figure 4:
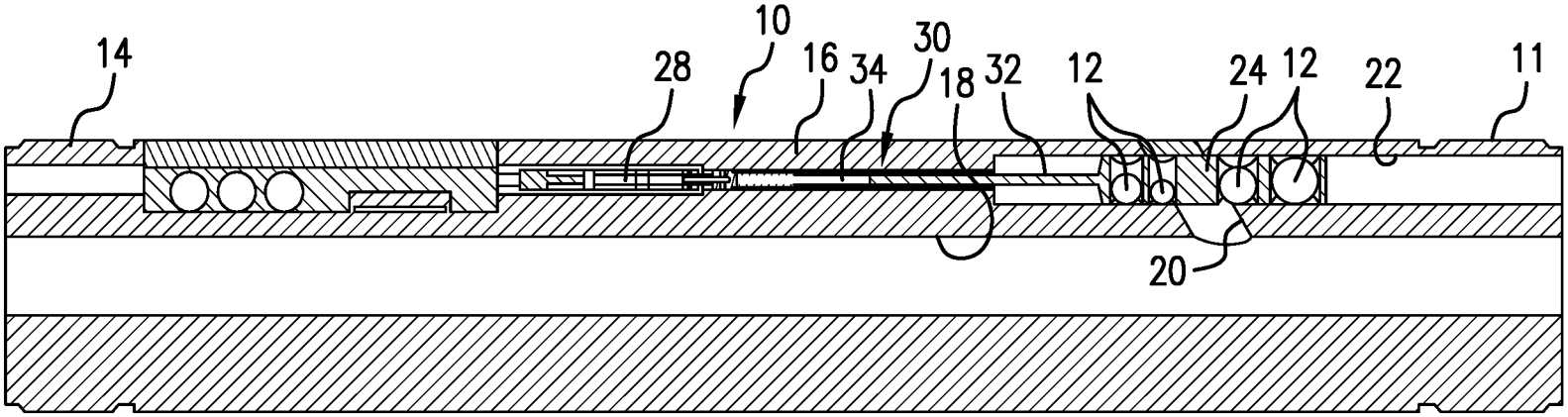
FIG. 4 is a cross sectional view of a similar device with an alternate object shuttle.

In one configuration of the device 10, objects of different dimensions are placed in the shuttle 24 in an order so that movement of the shuttle 24 in a single direction will sequentially release larger and larger dimension objects. Those of skill in the art will appreciate the use of sequentially larger objects to actuate sequential downhole tools and needs no explanation. It is also contemplated to have the shuttle move in one direction first to release one set of objects and then in the opposite direction to release another set of objects (see FIG. 4). In the embodiment of FIG. 4, the supply bore 22 may be shorter and still accommodate the same number of objects in the shuttle 24 as a longer supply bore 22 would with the shuttle 24 only moving in one direction.

Figure 5:
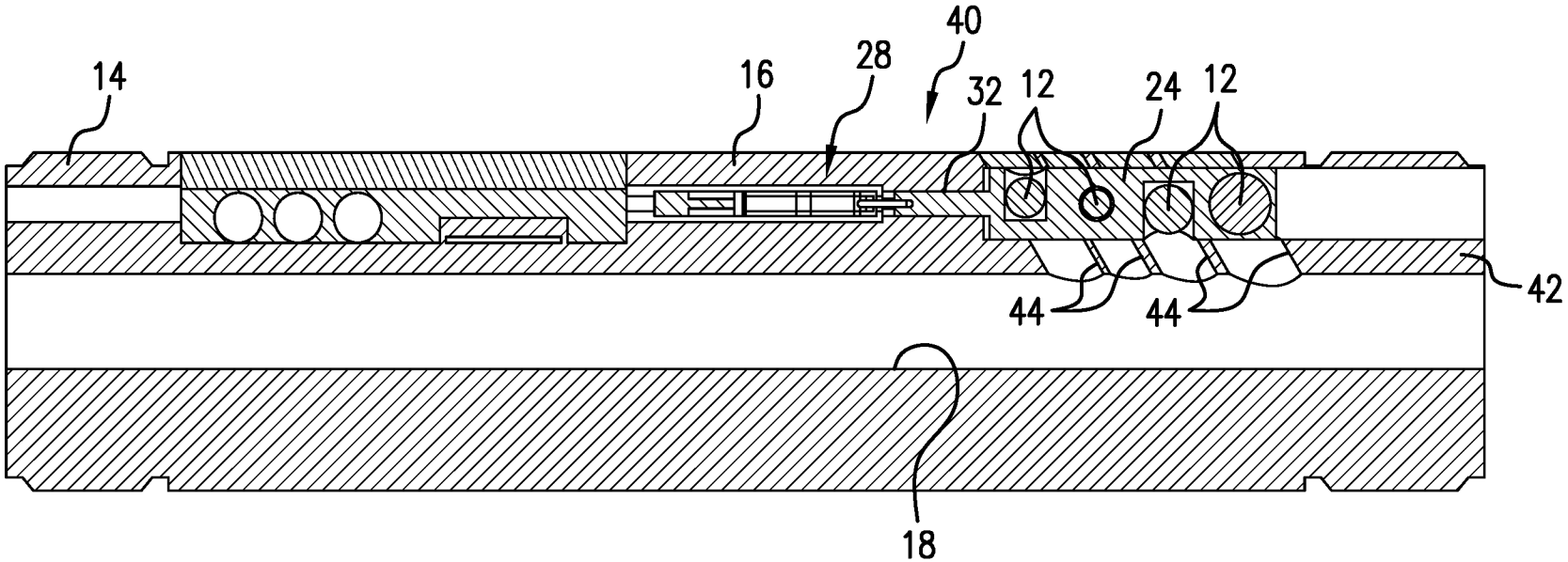
FIG. 5 is a cross sectional view of an alternate object release device.
Figure 6:
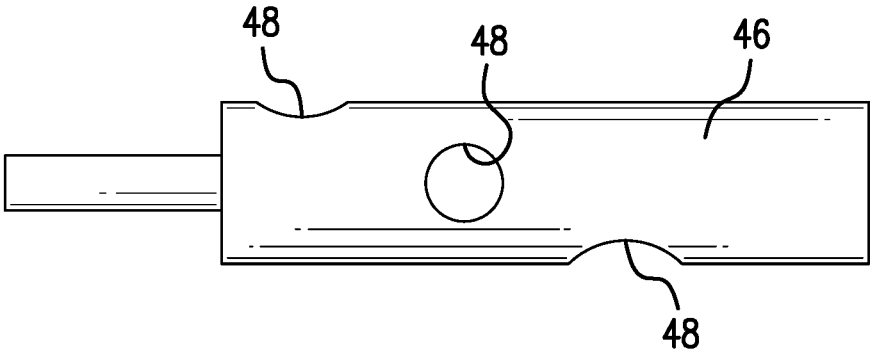
FIG. 6 is a side view of the object shuttle of the alternate device of FIG. 4.
Figure 7:
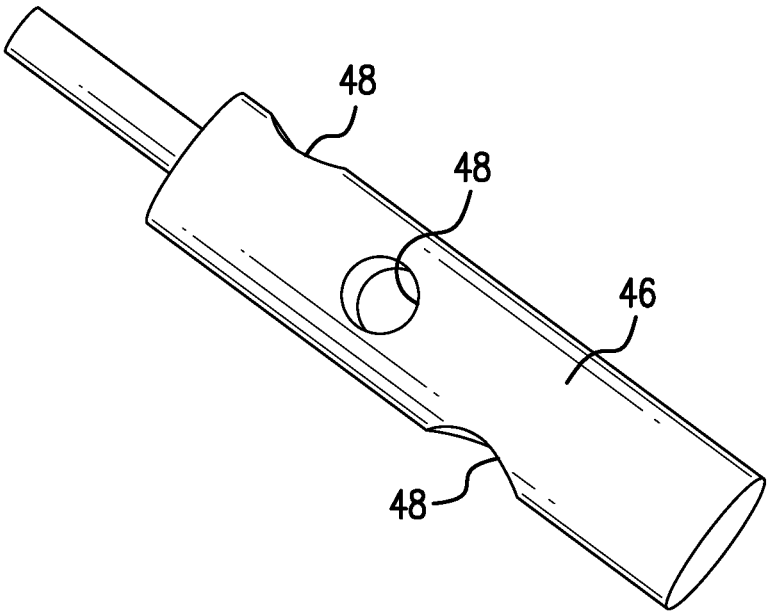
FIG. 7 is a perspective view of the shuttle illustrated in FIG. 5.

In an alternate embodiment of the object release device 40, referring to FIG. 5-7, It will be appreciated that housing 42 includes more object bores 44 than the embodiment of FIG. 1. Shuttle 46 is also distinct from the shuttle 24 in FIG. 1. This shuttle 46 is longitudinally fixed and rotationally free. The objects 12 are released in this embodiment by rotation of the shuttle 46 to align recesses 48 with the appropriate object bore 44. In order to control the release of objects 12 in this embodiment, the recesses 48 are disposed at angles about the circumference of the shuttle 46 such as at 90, 180, 270 and 0 degrees, as illustrated in FIG. 4. It will be appreciated that other angles could also be used. The motive arrangement 28 for the embodiment need only rotate and be capable of stopping rotation with the selected object 12 and recess 48 aligned with the appropriate object bore 44.

Figure 8:
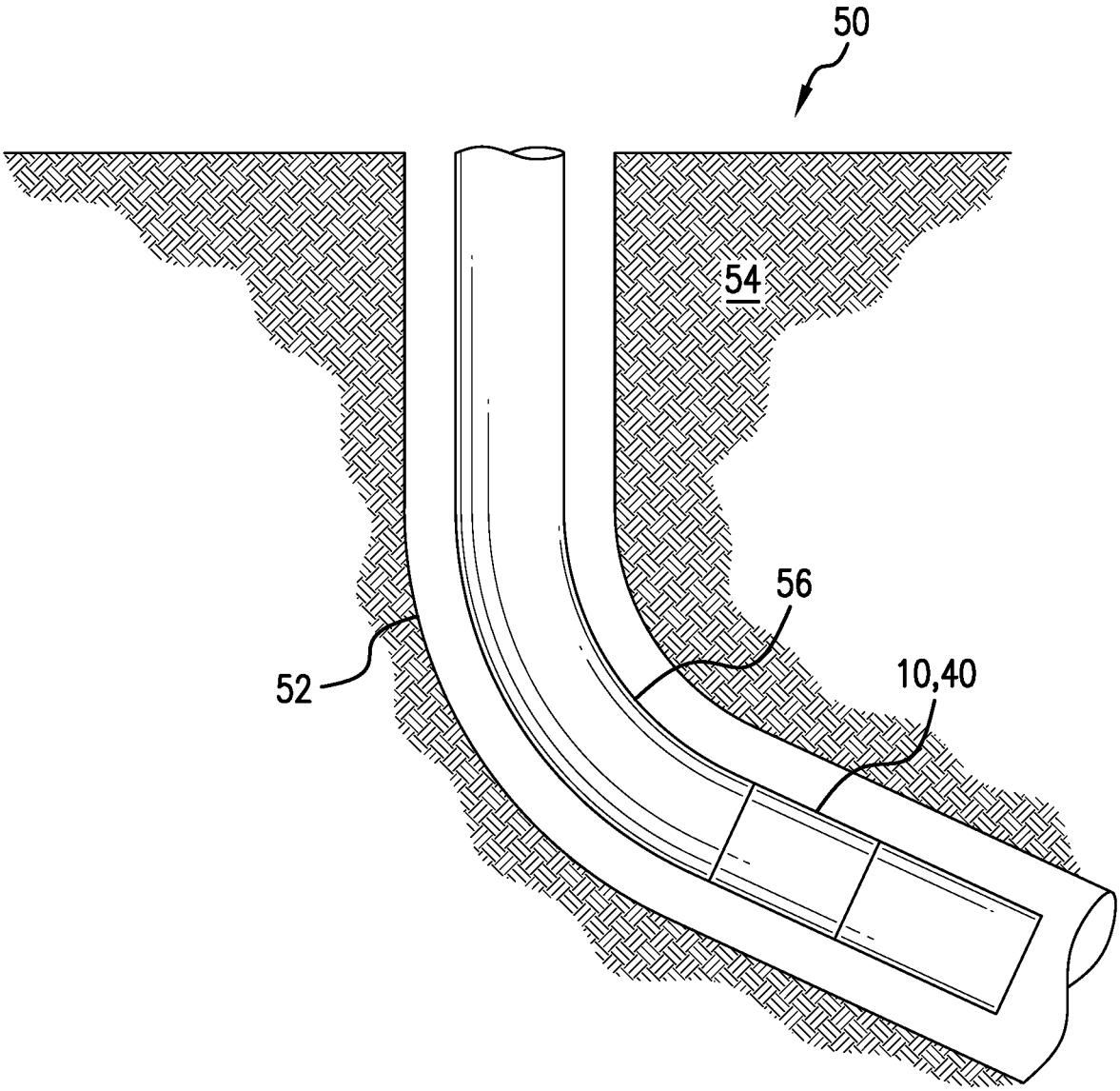
FIG. 8 is a view of a borehole system eluding the object release device as disclosed herein.

Referring to FIG. 8, a borehole system 50 is illustrated. System 50 includes a borehole 52 in a subsurface formation 54. A string 56 is disposed within the borehole 52. An object release device TO, 40 disposed within or as a part of the string 56.

Set forth below are some embodiments of the foregoing disclosure:

Embodiment 1: An object release device including a housing defining a longitudinally extending through bore and an object bore intersecting the through bore and a supply bore intersecting the object bore, an object shuttle disposed in the supply bore, and a motive arrangement attached to the shuttle through a driver.

Embodiment 2: The device as in any prior embodiment wherein the object shuttle includes object recesses therein.

Embodiment 3: The device as in any prior embodiment wherein the recesses are annular scallops in the shuttle.

Embodiment 4: The device as in any prior embodiment wherein the recesses are openings in the shuttle that are clearance sized for each object to be disposed therein.

Embodiment 5: The device as in any prior embodiment wherein the shuttle is longitudinally moveable.

Embodiment 6: The device as in any prior embodiment wherein the shuttle is rotationally moveable.

Embodiment 7: The device as in any prior embodiment wherein the object bore is a plurality of object bores in the housing.

Embodiment 8: The device as in any prior embodiment wherein each of the plurality of object bores is alignable with one of a plurality of recesses in the object shuttle.

Embodiment 9: The device as in any prior embodiment wherein the driver is a rotary motion to linear motion translator.

Embodiment 10: The device as in any prior embodiment wherein the rotary motion to linear motion translator is a lead screw and follower configuration.

Embodiment 11: The device as in any prior embodiment wherein the driver is a drive shaft.

Embodiment 12: The device as in any prior embodiment wherein the motive arrangement is a motor.

Embodiment 13: A method for actuating a downhole tool including sending a signal to the motive arrangement as in any prior embodiment, and moving the shuttle to align an object with the object bore.

Embodiment 14: The method as in any prior embodiment wherein the moving is linearly moving.

Embodiment 15: The method as in any prior embodiment wherein the moving is rotationally moving.

Embodiment 16: The method as in any prior embodiment wherein the moving to align is to a specific object or a plurality of objects stored in the object shuttle.

Embodiment 17: A borehole system including a borehole in a subsurface formation, a string in the borehole, an object release device as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An object release device comprising:

a housing defining a longitudinally extending through bore and an object bore intersecting the through bore and a supply bore intersecting only the object bore;

an object shuttle disposed in the supply bore, the object shuttle having a plurality of recesses disposed at angles about a circumference of the object shuttle; and a motive arrangement attached to the shuttle and configured to rotate the object shuttle to align or misalign a recess of the plurality of recesses with the object bore.

2. The device as claimed in claim 1 wherein the recesses are disposed at 90, 180, 270, and 0 degrees.

3. The device as claimed in claim 2 wherein the recesses are blind bores in the shuttle.

4. The device as claimed in claim 1 wherein the shuttle is longitudinally fixed.

5. The device as claimed in claim 1 wherein the shuttle is rotationally moveable by a specific number of degrees to align with a specific object bore.

6. The device as claimed in claim 1 wherein the object bore is a plurality of object bores in the housing.

7. The device as claimed in claim 1 wherein the motive arrangement is a motor.

8. A method for actuating a downhole tool comprising:

sending a signal to the motive arrangement as claimed in claim 1; and rotationally moving the shuttle to align an object with the object bore.

9. The method as claimed in claim 8 wherein the moving is a specific number of degrees of rotation.

10. The method as claimed in claim 8 wherein the moving to align is to a specific object or a plurality of objects stored in the object shuttle.

11. A borehole system comprising:

a borehole in a subsurface formation;

a string in the borehole;

an object release device as claimed in claim 1 disposed within the borehole within or as a part of the string.

12. An object release device comprising:

a housing defining a longitudinally extending through bore and an object bore intersecting the through bore and a supply bore intersecting only the object bore;

an object shuttle disposed in the supply bore, the object shuttle having a plurality of recesses disposed at angles about a circumference of the object shuttle, wherein the shuttle is rotationally moveable; and a motive arrangement attached to the shuttle through a driver.

13. A method for actuating a downhole tool comprising:

sending a signal to the motive arrangement as claimed in claim 1; and moving the shuttle to align an object with the object bore, wherein the moving is rotationally moving.

* * * * *